US005463207A

United States Patent [19]

Kang

[11] Patent Number: 5,463,207

[45] Date of Patent: Oct. 31, 1995

[54] WEIGHT SENSING APPARATUS OF A MICROWAVE OVEN HAVING A TURNTABLE

[75] Inventor: Kwang S. Kang, Suwon, Rep. of Korea

[73] Assignee: Samsung Electronics Co., Ltd., Suwon, Rep. of Korea

[21] Appl. No.: 370,986

[22] Filed: Jan. 10, 1995

[30] Foreign Application Priority Data

Feb. 28, 1994 [KR] Rep. of Korea ..... 94-3783

[51] Int. Cl.$^6$ ..... H05B 6/68; H05B 6/78

[52] U.S. Cl. ..... 219/708; 219/754; 219/518

[58] Field of Search ..... 219/708, 754, 219/755, 752, 753, 518; 108/20, 139

[56] References Cited

U.S. PATENT DOCUMENTS

| | | | |
|---|---|---|---|
| 4,631,379 | 12/1986 | Aoyama | 219/754 |
| 4,673,800 | 6/1987 | Hirai et al. | 219/708 |
| 4,918,275 | 4/1990 | Okamoto et al. | 219/754 |
| 5,034,587 | 7/1991 | Takagi | 219/754 |
| 5,097,106 | 3/1992 | Arai et al. | 219/754 |

*Primary Examiner*—Philip H. Leung

*Attorney, Agent, or Firm*—Burns, Doane, Swecker & Mathis

[57] ABSTRACT

The weight sensing apparatus of this invention which is made for quick and exacting sensing of a foodstuff's weight to be cooked, includes a pair of arms extending downward from the bottom of a turntable and a pair of projections extending inward from the body of a support member which supports the rotating turntable. When the turntable rotates, the arms engage with the projections so that the support member can rotate at the same speed as that of the turntable. The plurality of guide rollers, which are rotatably connected to the support member, press down at least one or more weight sensors which are disposed in a groove offering a circular track, and thereby sensing the weight of the foodstuff quickly and exactly.

4 Claims, 5 Drawing Sheets

WEIGHT SENSING APPARATUS OF A MICROWAVE OVEN HAVING A TURNTABLE

BACKGROUND OF THE INVENTION

This invention relates to a microwave oven, and more particularly to the weight sensing apparatus of a microwave oven which can measure the weight of a foodstuff on a turntable, and thereby determine the proper cooking time of the foodstuff.

As shown in FIG. 1, a typical microwave oven includes an outer case 1 having an opening formed in the front, a cooking chamber 2 formed in the interior of the outer case 1, a door 3 installed on the front of the outer case 1, and a rotating turntable 40 placed on the bottom of the cooking chamber 2 for supporting foodstuffs.

The turntable 40 is connected to a motor 50 that is provided under the cooking chamber 2, by a driving shaft 52 and that is rotated at a low speed (see FIG. 7).

In order to support the rotating turntable 40, a support member 60 of a ring-shape and a plurality of guide rollers 61, which are connected to the circumference of the support member 60, are provided under the turntable 40.

As shown in FIGS. 6 and 7, the turntable 40 is placed on the guide rollers 61. A ring-shape groove 80 that is a little wider than the width of the guide rollers 61 is formed on the bottom of the cooking chamber 40. This allows the guide rollers 61 to move in circular motion along the track. A weight sensor 90 for measuring a foodstuff's weight is provided in a hole 81 which is formed on the groove 80. As shown in FIG. 8, the weight sensor 90 comprises a sensing element 91 of which a portion protrudes above the hole 81 and a piezoelectric element 92 which contacts the bottom of the sensing element 91.

When the turntable 40 is rotated by the driving force of the motor 50, the guide rollers 61 rotate on the groove 80 of circular track caused by the frictional force between the bottom surface of the turntable 40 and the circumference surface of the guide rollers 61. When one of the guide rollers 61 passes over the hole 81 formed on the groove 80, the sensing element 91 is pressed down in proportion to the weight of the foodstuff that is put on the turntable 40. The piezoelectric element 92 then changes the sensed weight to an electric signal and subsequently transmits it to a controller (not shown). As a result, the cooking time of the foodstuff is fixed.

However, in a conventional weight sensing apparatus the guide rollers 61 do not rotate on the groove 80 at the same speed as that of the turntable 40. This is due to the insufficient friction force between the guide rollers 61 and the turntable 40 which slowly rotates by means of the motor 50, causing the turntable 40 to slip on the guide rollers 61 with each rotation.

Accordingly, a relatively long time passes until any one of the guide rollers 61 crosses over the sensing element 91 of the weight sensor 90, and therefore a decision on the cooking time relative to the weight of a foodstuff is delayed.

Furthermore, the guide rollers 61 do not only rotate within the center circle of the groove 80, where the weight sensor 90 is located in, but may rotate off the center circle in a right or left direction. This is because the guide rollers 61, which are connected to the support member 60, are rotated only by the friction force in the state of contact between the bottom surface of the turntable 40 and the groove 80 without any connecting device between the turntable 40 and the support member 60 or the guide rollers 61.

Therefore, it is possible that the guide rollers 61 do not correctly step on the sensing element 91 of the weight sensor 90, and consequently the cooking time of a foodstuff may be incorrectly decided.

This becomes a factor in impairing the reliability of the article.

SUMMARY OF THE INVENTION

An objection of this invention is to provide a weight sensing apparatus for a microwave oven which is able to sense the weight of a foodstuff quickly.

Another objection of this invention is to provide a weight sensing apparatus for a microwave oven which is able to sense the weight of a foodstuff correctly.

The weight sensing apparatus in accordance with this invention comprises as follows: a turntable which supports the foodstuff to be cooked, and is rotated by a driving motor; a support member which comprises a ring-shaped body and a plurality of guide rollers that are rotatably connected to the outer circumference of the body, and which supports the rotating turntable; a ring-shaped groove for forming a track that guides the circular motion of the guide rollers, where one or more through holes are disposed at regular intervals; at least one or more weight sensors comprising a sensing element and a piezoelectric element for sensing the weight of the foodstuff in a manner that the upper portion of the sensing element extends above the through hole, and is pressed down by the circulating guide roller; and a connecting means which is positioned between the turntable and the support member for rotating the guide rollers and the turntable at a same speed.

The guide rollers of the support member rotate at the same speed as that of the turntable along the circular track of the groove using the action of a connecting means, and then press the sensing elements of the weight sensors projecting above the through holes, in order that the weight sensing apparatus according to this invention can sense the weight of the foodstuff quickly and correctly.

This invention has two aspects in accordance with the structure of the connecting means.

In the first aspect, the connecting means comprises of at least one or more arms extending downward from the bottom surface of the turntable and at least one or more projections extending inward from the inner circumference of the body of the support member. When the turntable rotates, the arms push the projections in the direction of the rotation so that the guide rollers rotate at the same speed as that of the turntable moving along the circular track of the groove.

The projections have concave portions on their opposite side surfaces in order to join the cylindrical arms smoothly when the turntable rotates, causing the guide rollers to rotate harmoniously with the turntable.

In the second aspect, the connecting means comprises a receiving hole formed by a pair of ring-shaped projections which extend downward from the bottom of the turntable, and an extension member extending upward from the body of the support member that inserts into the receiving hole. When the turntable rotates, the guide rollers rotate at the same speed as that of the turntable moving along the circular track of the groove by the extension member inserted into the receiving hole.

DETAILED DESCRIPTION OF THE PREFERRED EMBODIMENTS

Figure 6:
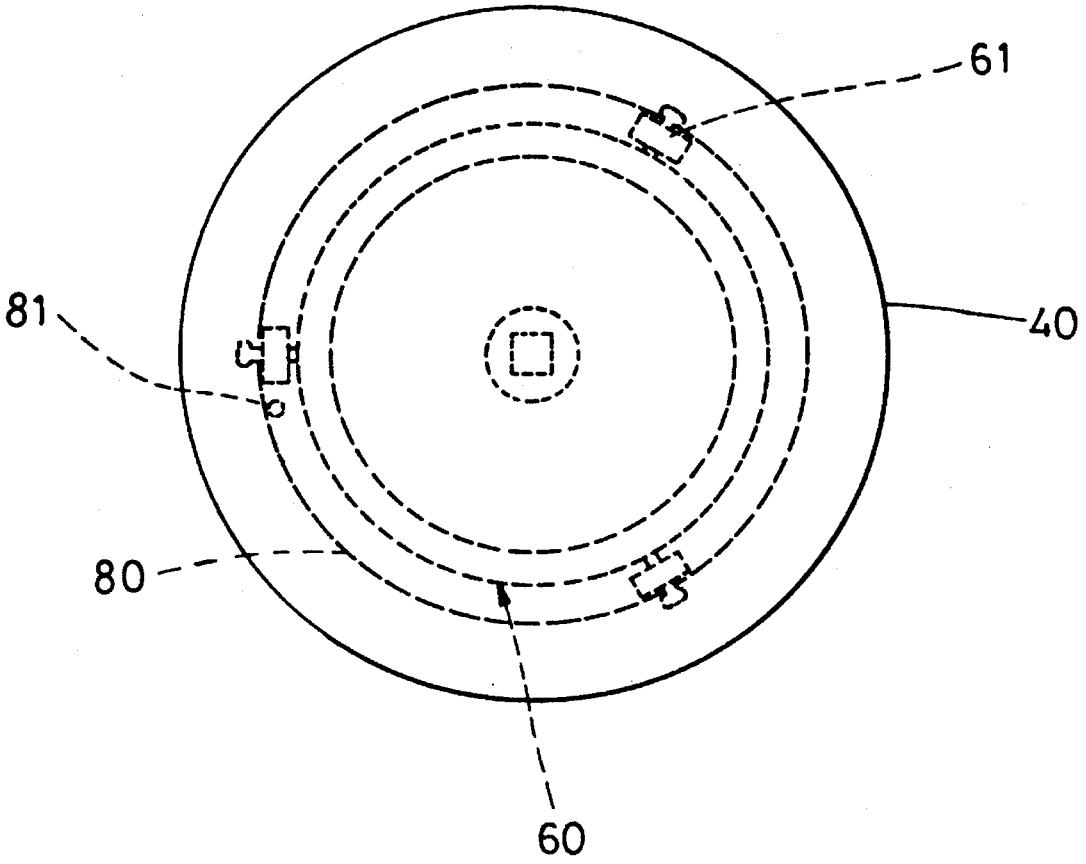
FIG. 6 (PRIOR ART)
FIG. 6 is a plan view illustrating a conventional weight sensing apparatus of a microwave oven.
Figure 7:
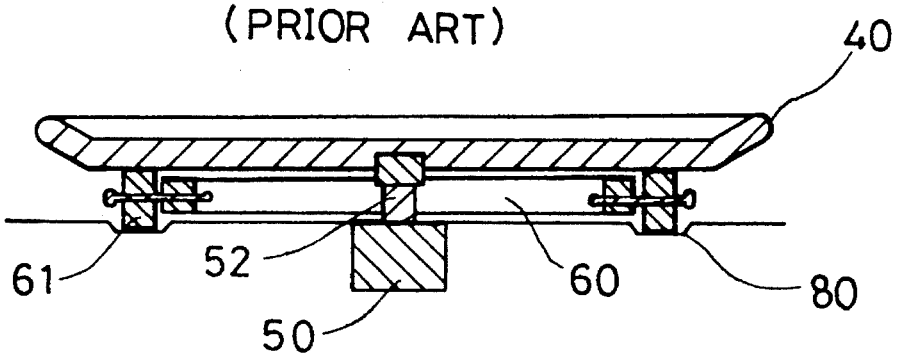
FIG. 7 (PRIOR ART)
FIG. 7 is a cross sectional view taken along the line VII—VII in FIG. 6.
Figure 8:
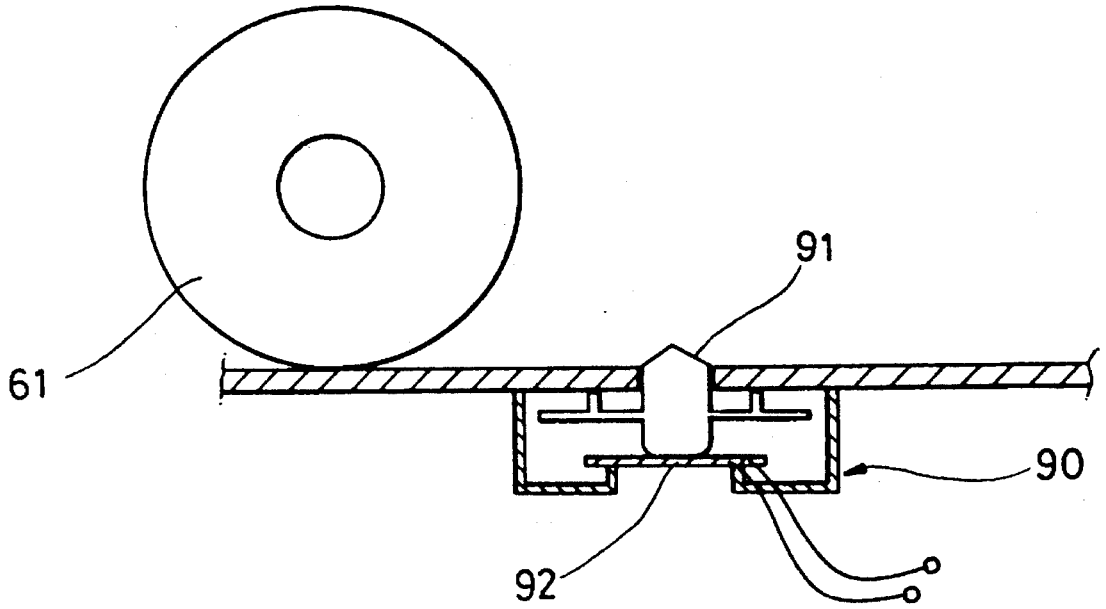
FIG. 8 (PRIOR ART)
FIG. 8 is a cross sectional view taken along the line VIII—VIII in FIG. 6.

The preferred embodiments in accordance with this invention will now be described in detail based on the attached drawings. For the sake of convenience, the same parts of this invention, as are the parts of the conventional weight sensing apparatus shown in FIGS. 6 to 8, are designated with the same numbers.

Figure 1:
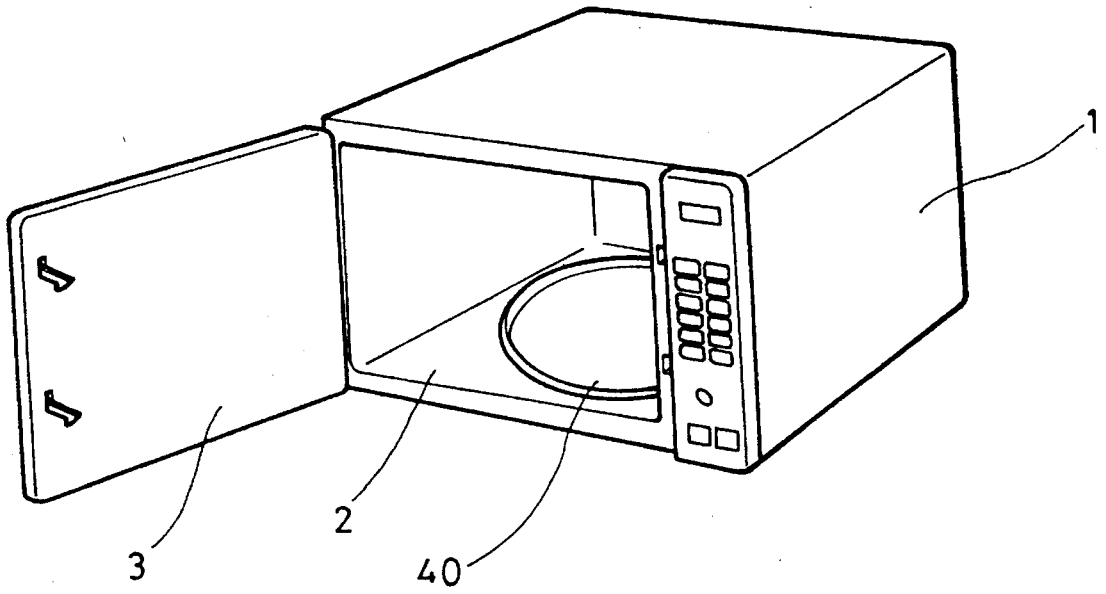
FIG. 1 is an overall perspective illustrating a turntable type microwave oven.
Figure 2:
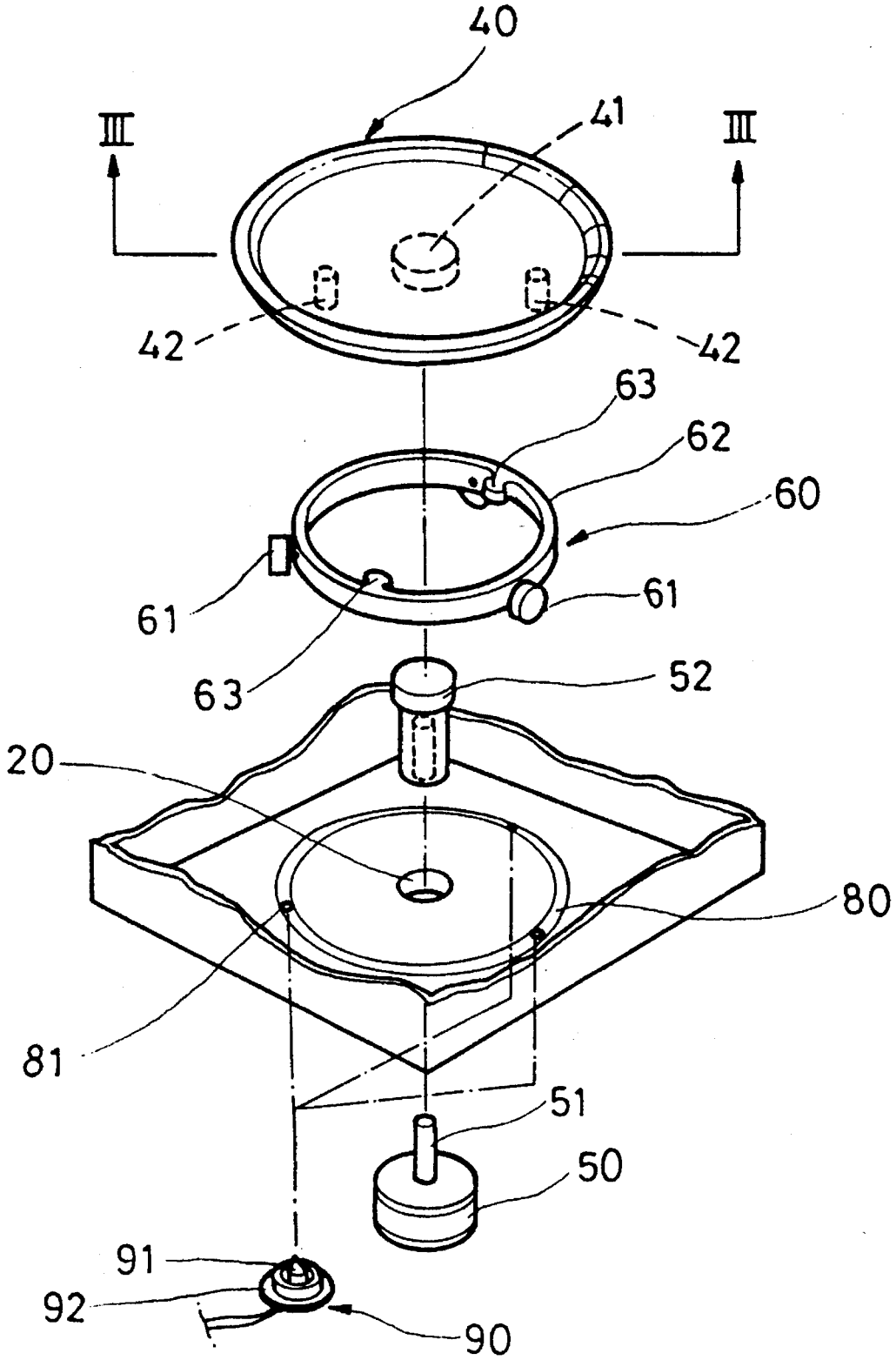
FIG. 2 is an exploded perspective illustrating the weight sensing apparatus of a microwave oven in accordance with a first embodiment of this invention.

As shown in FIG. 2, the weight sensing apparatus in accordance with a first embodiment of this invention comprises a turntable 40, a support member 60, a motor 50, a connecting shaft 52, a ring-shaped groove 80, and a plurality of weight sensors 90.

At the center of the bottom surface of the cooking chamber 2, a center hole 20 is formed for receiving the connecting shaft 52 which connects the motor 50 to the turntable 40.

The groove 80 is positioned at a radially fixed distance away from the center hole 20. The groove 80 having a fixed width is used as a circular track for guide rollers 61 which will be described afterwards. A plurality of holes 81 are formed on the groove 80.

The weight sensors 90, which comprise a sensing element 91 and a piezoelectric element 92, are disposed under the cooking chamber 2, and the upper portion of each sensing element 91 is projected upward through each hole 81.

The support member 60 comprises a ring-shaped body 62, a plurality of guide rollers 61 which are connected to the outer circumference of the body 62, and a pair of projections 63 extending inward from the inner circumference of the body 62.

The projections 63 stand opposite of each other in the interior of the body 62, and concave portions 64 are formed on opposite side surfaces of each projection 63.

The support member 60 has a shape such that the top end of the body 62 is higher than that of the guide rollers 61 and the bottom ends of the guide rollers 61 are lower than that of the body 62.

Accordingly, the guide rollers 61 of the support member 60 are placed in the groove 80, and the turntable 40 is placed on the body 62 of the support member 60.

Figure 3:
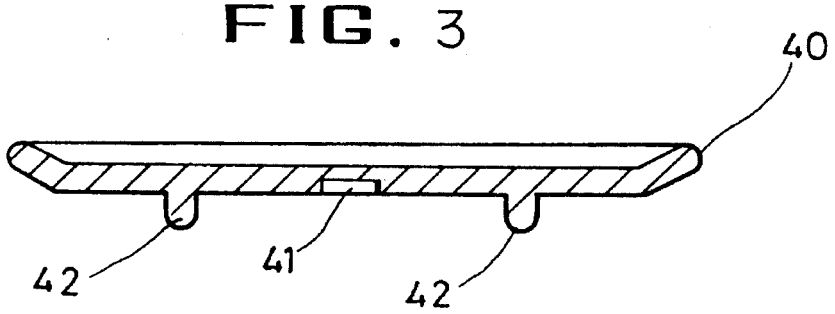
FIG. 3 is a cross sectional view taken along the line III—III in FIG. 2.
Figure 4:
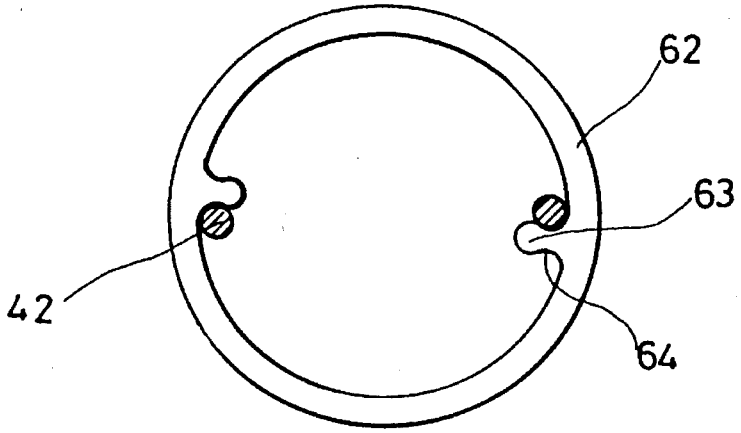
FIG. 4 is a view showing the arms formed at the bottom of the turntable and projections formed on the body of the support member joined in accordance with the first embodiment.

As shown in FIG. 3, at the bottom center of the turn table 40, an engaging hole 41 is formed for connection with the connecting shaft 52, and a pair of arms 42 are formed at the bottom of the turntable 40. The arms 42 stand opposite to each other at the same distance from the engaging hole 41.

The turntable 40, after being placed on the body 62 of the support member 60, is connected to the motor 50 by the connecting shaft 52 that is rotated by the motor 50.

During operation, the turntable 40 is rotated by the connecting shaft 52 with the motor 50. The arms 42, which are formed on the bottom of the turntable 40, then engage with the concave portions 64 of the projections 63 which are formed on the body 62 of the support member 60.

Therefore, the guide rollers 61 of the support member 60 begin to rotate with the turntable 40 moving along the circular track of the groove 80.

Accordingly, the guide rollers 61 pass over the sensing elements 91 of the weight sensors 90 within a short period of time, and therefore the sensing elements 91 are pressed down by the guide rollers 61. The pressure on the sensing elements 91, pressed by the weight of the turntable 40 and a foodstuff thereon, is converted to a voltage signal by the piezoelectric elements 92, and then is transferred to a controller (not shown). The controller decides the cooking time for the foodstuff based on the signal.

Figure 5:
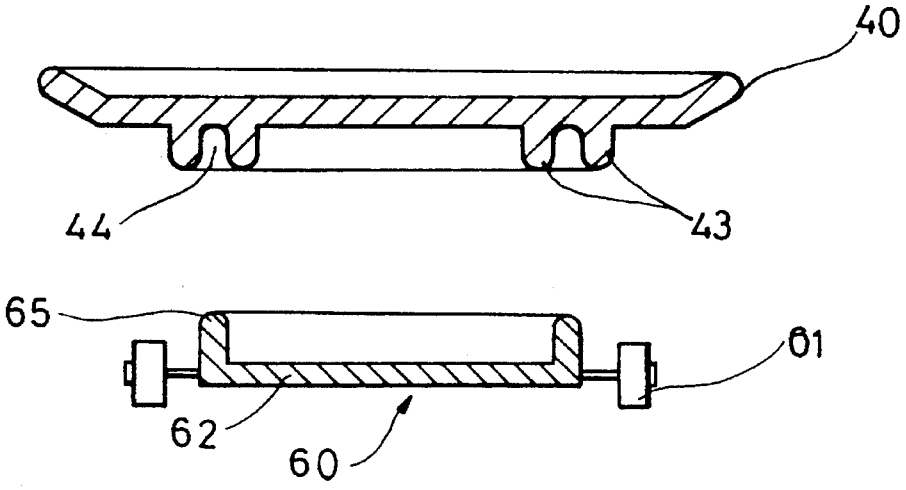
FIG. 5 is a view showing the receiving hole formed at the bottom of the turntable and the extension member formed on the body of the support member in accordance with a second embodiment of this invention.

FIG. 5 shows a second embodiment in accordance with this invention. In the second embodiment, a pair of ring-shaped projections 43 are formed on the bottom surface of the turntable 40 at regular intervals to each other. Also an extension member 65, which is a mate to the projections 43, is formed by extending upwards from the ring-shaped body 62 of the support member 60.

The extension member 65 is inserted into a receiving hole 44 which is formed by a pair of ring-shaped projections 43 in order that the guide rollers 61 and the turntable 40 can rotate as one body.

As a result, the guide rollers 61 pass over the sensing elements 91 of the weight sensors 90 within a shorter period of time than that in the first embodiment aforementioned.

As can be understood from the above description, this invention has advantages in that the cooking time for foodstuffs is shortened and foodstuffs are cooked properly. This is because the guide rollers of the turntable, which rotatably supports the turntable, rotate at the same speed as that of the turn table along the exact circular track of the groove, of which the weight sensors are disposed. Consequently, the weight sensing apparatus, in accordance with this invention, can quickly and exactly sense the weight of the foodstuff to be cooked.

What is claimed is:

1. A weight sensing apparatus of a microwave oven comprising:

a turntable which supports a foodstuff to be cooked and is rotated by a driving motor;

a support member which comprises a ring-shaped body and a plurality of guide rollers that are connected to the outer circumference of said body, and supports said rotating turntable;

a ring-shaped groove for forming a track to guide the circular motion of said guide rollers, which includes one or more through holes disposed at regular intervals;

at least one or more weight sensors comprising a sensing element and a piezoelectric element, that can sense the weight of the foodstuff in such a manner that the upper portion of each said sensing element extends above said through holes and is pressed down by said circulating guide rollers;

a connecting means which is positioned between said turntable and said support member for rotating the guide rollers and the turntable at a same speed, whereby said guide rollers of said support member rotate at the same speed as that of said turntable along the circular track of said groove by the action of said connecting means, and then press down said sensing elements of said weight sensors projecting above said through holes, so that the weight of the foodstuff is sensed quickly and correctly.

2. A weight sensing apparatus of a microwave oven according to claim 1, wherein said connecting means comprises at least one or more arms extending downward from the bottom surface of said turntable and at least one or more projections extending inward from the inner circumference of said body of said support member, whereby when said turntable rotates, said arms push against said projections in the rotating direction, so that said guide rollers rotate at the same speed as that of said turntable moving along the circular track of said groove.

3. A weight sensing apparatus of a microwave oven according to claim 2, wherein said projections have concave portions on their opposite side surfaces in order to join said cylindrical arms smoothly when said turntable rotates, so that said guide rollers rotate harmoniously with said turntable.

4. A weight sensing apparatus of a microwave oven according to claim 1, wherein said connecting means comprises a receiving hole formed by a pair of ring-shaped projections which extend downwards from the bottom of said turntable, and an extension member extending upward from said body of said support member to insert into said receiving hole, whereby when said turntable rotates, said guide rollers rotate at the same speed as that of said turntable moving along the circular track of said groove by said extension member inserted into said receiving hole.

* * * * *